US007918495B2

(12) United States Patent
Chen

(10) Patent No.: US 7,918,495 B2
(45) Date of Patent: Apr. 5, 2011

(54) DIRECTOR'S CHAIR

(76) Inventor: Gao-Shan Chen, Tainan (TW)

( * ) Notice: Subject to any disclaimer, the term of this patent is extended or adjusted under 35 U.S.C. 154(b) by 144 days.

(21) Appl. No.: 12/321,724

(22) Filed: Jan. 26, 2009

(65) Prior Publication Data

US 2010/0187866 A1 Jul. 29, 2010

(51) Int. Cl.
*A47C 4/00* (2006.01)

(52) U.S. Cl. ..... 297/42; 297/44

(58) Field of Classification Search ..... 297/42, 297/44, 45

See application file for complete search history.

(56) References Cited

U.S. PATENT DOCUMENTS 6,540,290 B2 * 4/2003 Liu ..... 297/45
7,641,276 B1 * 1/2010 Chen ..... 297/42
2010/0013273 A1 * 1/2010 Chen ..... 297/42 X

* cited by examiner

*Primary Examiner* — Anthony D Barfield

(57) ABSTRACT

A director's chair comprises outer frames, connecting units, seat supporting units and back supporting units. The outer frame in square shape comprises with a pair of horizontal units and a pair of vertical units. A seat-supporting-unit connected piece setting under the top right angle of the horizontal unit. A stopper is set inside of each front and rear vertical unit. The connecting units which are pivotally crisscrossed with each other form an arc-shaped and an up-side-down arc-shaped connecting structure. The front protruding end of the seat supporting unit is curved. The back supporting unit comprises a supporting unit and a fitting seat wherein a concave is inside and a movable piece is at the bottom of the fitting seat.

5 Claims, 11 Drawing Sheets

DIRECTOR'S CHAIR

BACKGROUND OF THE PRESENT INVENTION

1. Field of the Invention

The present invention relates to a director chair, and more particular to a foldable chair comprising with outer frames, connecting units, seat supporting units and the back supporting units.

2. Description of the Related Art

The prior invention as shown in FIGS. 1 through 5, comprises two main leg frames, two interior leg frames and elastic plates. The main leg frames is in square shape and the interior leg frames is in ⊓shape which are pivotally crisscrossed with each other with a suitable angle. Each elastic plate is positioned separately on top right angles of the interior leg frame pivotally connecting with the middle portion of each main leg frame. The lower portion of each interior leg frame is pivotally connected with the lower portion of the main leg frame. The canvas seat is installed between two interior leg frames. However, the prior invention mentioned above has the following shortcomings:

First, when unfolding the chair, top of the interior leg frames have to be held and pressed to elastically move the elastic plates downward in a flash moment which might clamp and hurt the user's fingers for the angles there between is getting smaller. Unless holding the top central portion of the interior leg frames and then pressing downward can prevent fingers from being hurt or even suffering bone fracture. However, it is still possible to hurt pats of the user's fingers during the unfolding process which might cause a huge safety concern.

Second, during folding process, in order to move the elastic plates downward, the bottom of main leg frames have to be stepped against to enforce the strength inwardly for folding the interior frames. When holding top of the interior leg frames, the back of the hands might be collided or clamped by the main leg frames resulting in difficulty for producing force and making folding process much more complicated and difficult.

Third, each connecting point of the elastic plate must be manufactured more accurate; otherwise, the function of others would be affected. However, the accuracy of the manufacture would relatively lower the producing effectiveness and market competitiveness.

Fourth, the whole structure would easily be damaged and deformed, once the elastic plates suffer from the user's weight for a long time.

Fifth, the length of the seat installed between the main and interior leg frame would be limited and the user's legs would easily bump into the front edge of the interior leg frame which is positioned within the main leg frame.

As shown in FIGS. 6 and 7, in order to improve the prior art mentioned above, the applicant has filed by Ser. No. 12/218,273 in US patent. A foldable director's chair comprises armrest units, leg frame units, gliding tubes, seat supporting units, back supporting units and connecting units. The armrest unit and a leg frame unit which are both hollow tubes with their right angle ends extending downward or upward for a suitable length against each other and connected through by a gliding tube. The retaining sleeves connect the armrest and leg frame unit so that one end of each gliding tube can be engaged through the armrest tube and fixed to each other via the retaining sleeves while another end engaged through the leg frame unit without being fixed allowing the armrest unit moving straightly upward or downward along the gliding tube. Inside edge of each retaining sleeve, there is a protrusion extending there from and pivotally engaged with each end of arc-shaped connecting unit respectively. The back supporting units need to be pressed down by hand to the armrest units when being in a folding position.

SUMMARY

The present invention relates to a director's chair which comprises outer frames, connecting units, seat supporting units and the back supporting units. The outer frame in square shape comprises with a pair of horizontal units and a pair of vertical units. A seat-supporting-unit connected piece is set under the top right angle of the horizontal unit. A stopper is set inside of each front and rear vertical unit which is respectively capped with sliding piece 1 and 2 which can slide up and down along the vertical unit.

The connecting units which are pivotally crisscrossed with each other form an arc-shaped and an up-side-down arc-shaped connecting structure. The connecting structure 1 is located in front of the whole structure wherein two ends of the arc-shaped connecting unit are joined to the sliding piece 1 on each vertical unit, and two ends of the up-side-down arc-shaped connecting unit are fixed to the retaining spot 1 on each vertical unit. The connecting structure 2 is located on the backside of the whole structure wherein two ends of the arc-shaped connecting unit are joined to the sliding piece 2 on each vertical unit, and two ends of the up-side-down arc-shaped are fixed to the retaining spot 2 on each vertical unit. The sliding pieces are located above the retaining spots, and retaining spots 2 are higher than retaining spots 1; therefore, connecting structure 2 is located higher than connecting structure 1. The front protruding end of the seat supporting unit is curved which keeps a distance with the outer frame. The back supporting unit comprises a supporting unit and a fitting seat wherein a concave is inside and a movable piece is at the bottom of the fitting seat.

The present invention mentioned above has the advantages as following:

First, the outer frame of the present invention is molded, so it is more stable.

Second, in the present invention, sliding pieces 1 and 2 can slide up and down along the vertical unit. It would be no longer sliding up and down through a gliding tube.

Third, when folding the back supporting unit, sliding pieces 2 are up to its bottom to enable it folded quickly to the outer frame.

Forth, connecting structure 2 is located higher than connecting structure 1, therefore, it is more comfortable for the user when sitting in the chair and not easily bumping into the frames.

DETAILED DESCRIPTION OF THE INVENTION

Figure 2:
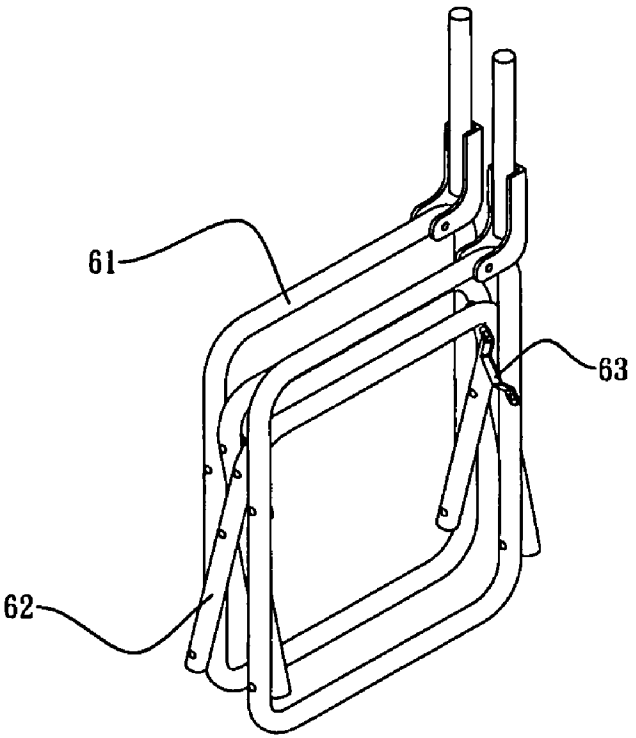
Fig. 2 PRIOR ART
FIG. 2 is a perspective view of the director's chair in folding position according to the conventional invention.
Figure 1:
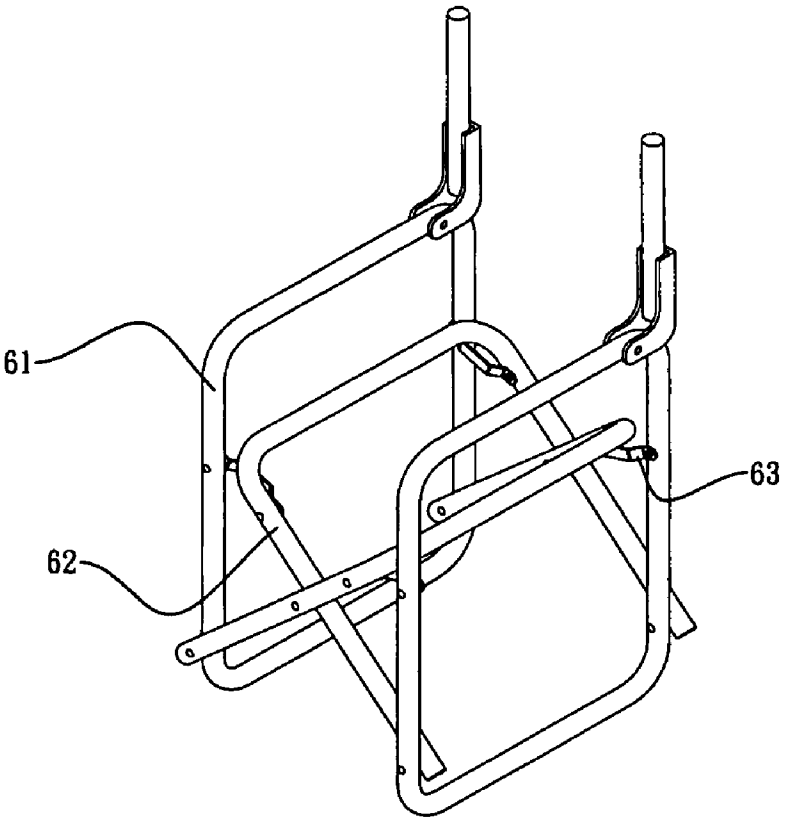
Fig. 1 PRIOR ART
FIG. 1 is a perspective view of the director's chair in unfolding position according to the conventional invention.
Figure 4:
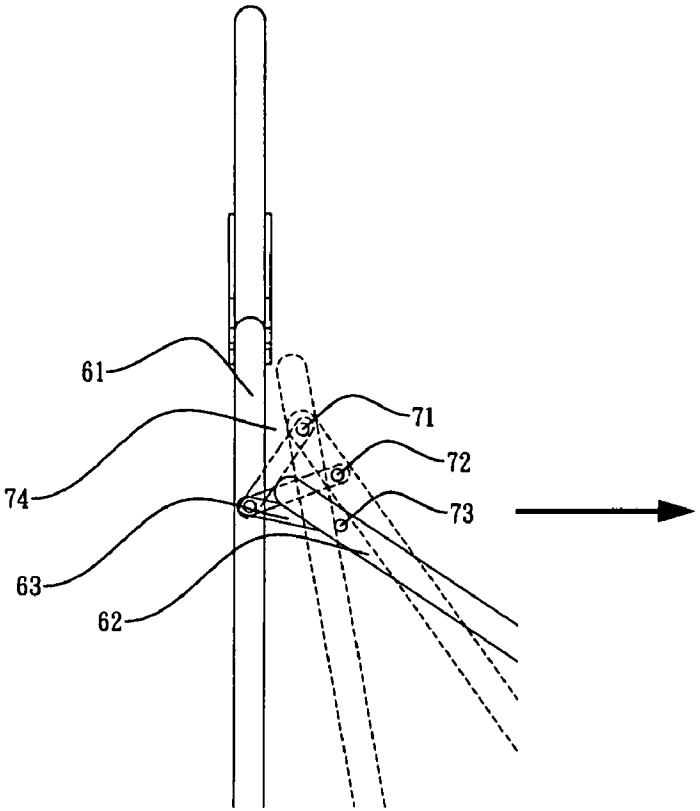
Fig. 4 PRIOR ART
FIG. 4 is a schematic drawing illustrating the unfolding position of the director's chair according to the conventional invention.
Figure 3:
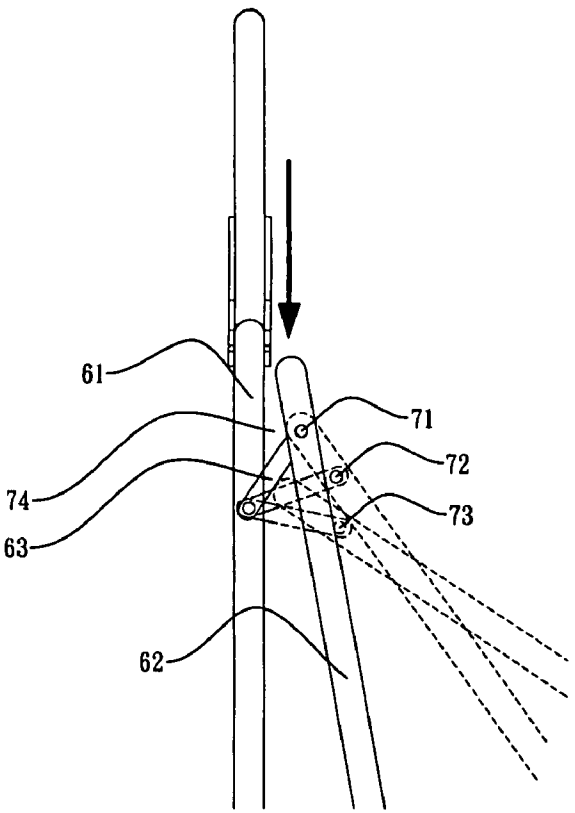
Fig. 3 PRIOR ART
FIG. 3 is a schematic drawing illustrating the folding position of the director's chair according to the conventional invention.
Figure 5:
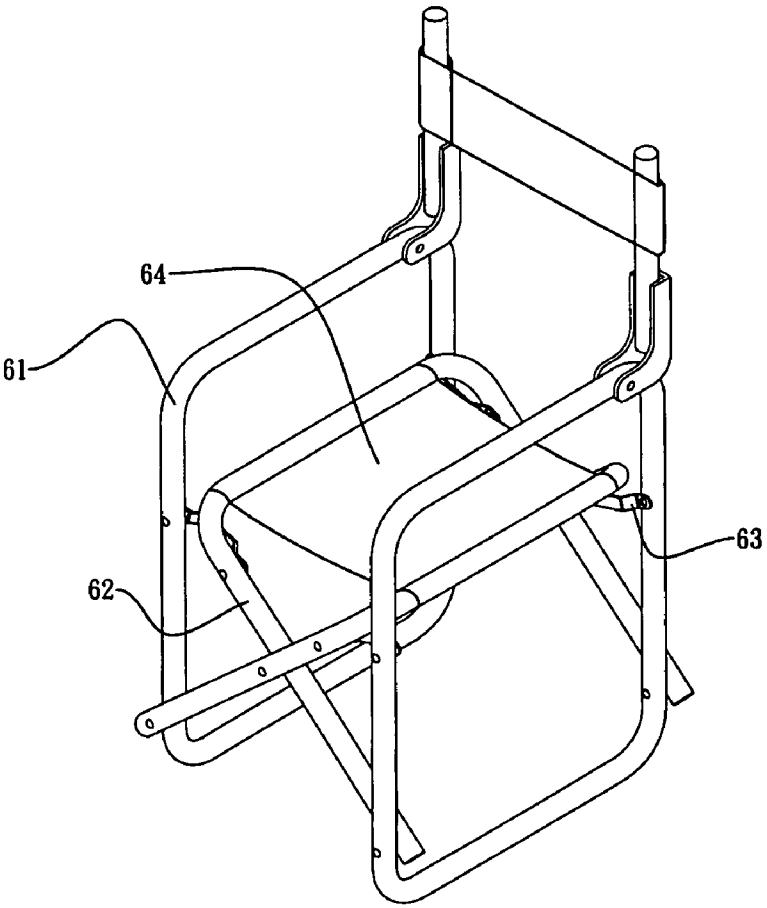
Fig. 5 PRIOR ART
FIG. 5 is a perspective view of the director's chair with a seat unit according to the conventional invention.
Figures 6, 7:
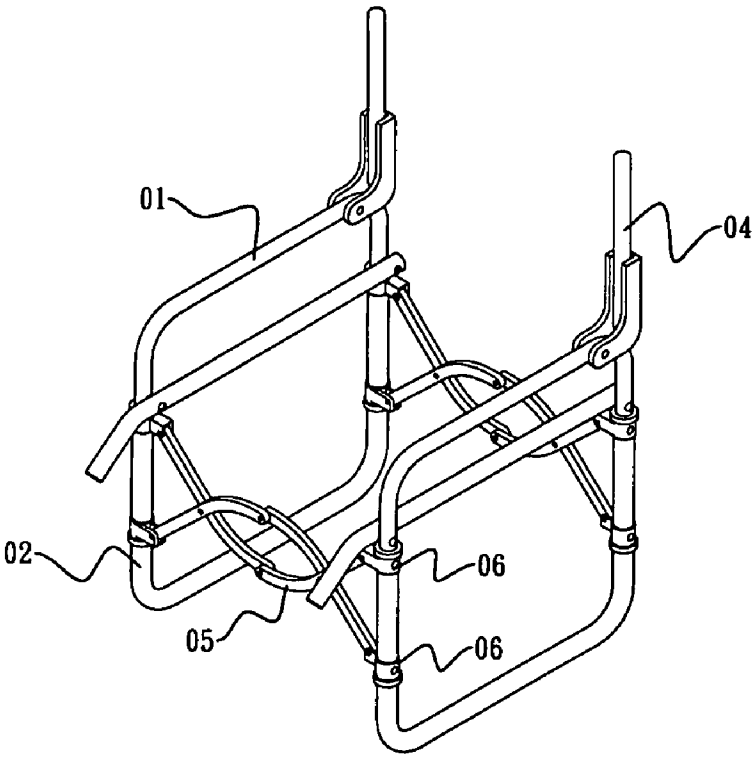
Fig. 7 PRIOR ART
Fig. 6 PRIOR ART
FIG. 6 is a perspective view of the foldable director's chair in unfolding position of the preferred embodiment according to the convention invention.
FIG. 7 is a perspective view of the foldable director's chair in folding position of the preferred embodiment according to the convention invention.
Figure 9:
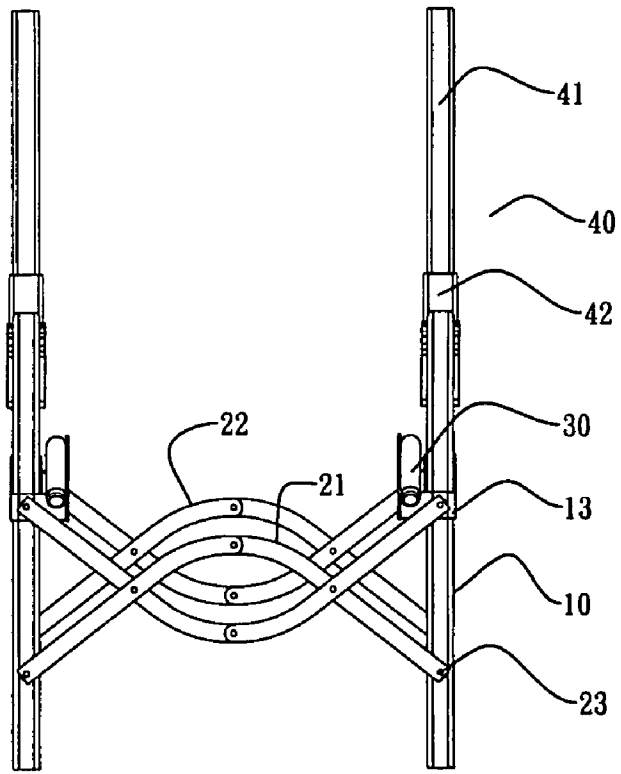
FIG. 9 is a front view of the director's chair in unfolding position of the preferred embodiment according to the present invention.

Referring to FIGS. 8 through 20, the director's chair includes outer frames (10), connecting units (20), seat supporting units (30) and the back supporting units (40). The outer frame (10) in square shape comprises with a pair of horizontal units (11) and a pair of vertical units (12). A seat-supporting-unit connected piece (111) is set under the top right angle of the horizontal unit (11). A stopper (121) is set inside of each front and rear vertical unit (12) which is respectively capped with sliding piece 1 (13) and sliding piece 2 (14) which can slide up and down along the vertical unit (12).

The connecting units (20) which are pivotally crisscrossed with each other form an arc-shaped and an up-side-down arc-shaped connecting structure. The connecting structure 1 (21) is located in front of the whole structure wherein two ends of the arc-shaped connecting unit (20) are joined to the sliding piece 1 (13) on each vertical unit (12), and two ends of the up-side-down arc-shaped connecting unit (20) are fixed to the retaining spot 1 (23) on each vertical unit (12). The connecting structure 2 (22) is located on the backside of the whole structure wherein two ends of the arc-shaped connecting unit (20) are joined to the sliding piece 2 (14) on each vertical unit (12), and two ends of the up-side-down arc-shaped connecting unit (20) are fixed to the retaining spot 2 (24) on each vertical unit (12). The sliding pieces are located above the retaining spots, and retaining spots 2 (24) are higher than retaining spots 1 (23); therefore, connecting structure 2 (22) is located higher than connecting structure 1 (21).

The front protruding end of the seat supporting unit (30) is curved which keeps a distance with the outer frame (10). The front end near the protruding part is joined to the sliding piece 1 (13), and the rear end of the seat supporting unit (30) is joined to the sliding piece 2 (14).

Figure 13:
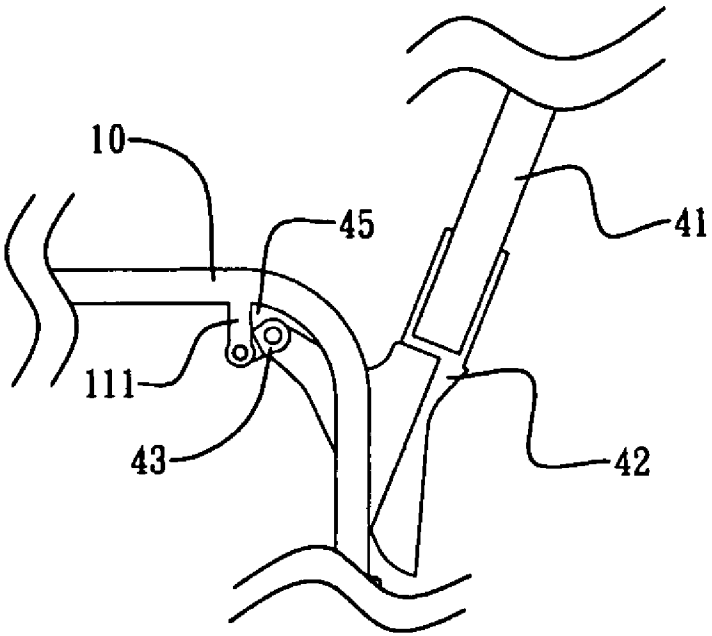
FIG. 13 is a perspective view of the director's with a back supporting unit in another position of the preferred embodiment according to the present invention.
Figure 12:
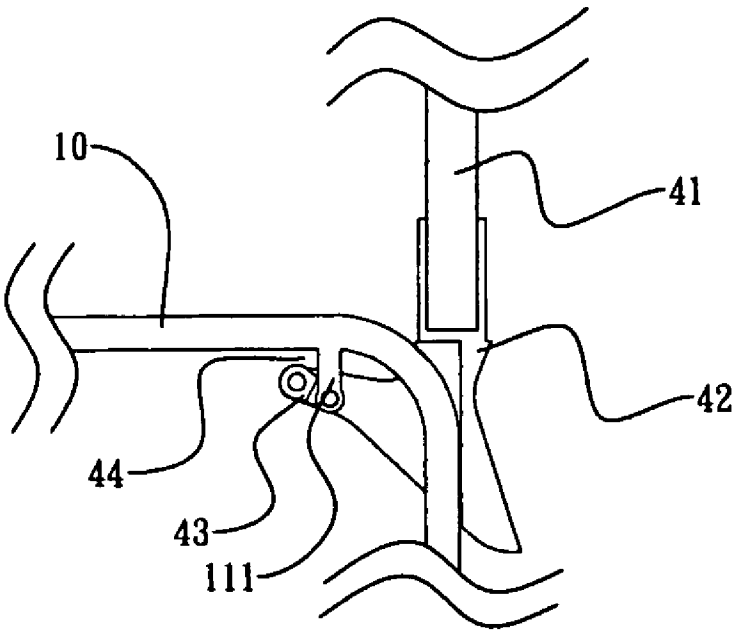
FIG. 12 is a perspective view of the director's with a back supporting unit in extension position of the preferred embodiment according to the present invention.

The back supporting unit (40) comprises a supporting unit (41) and a fitting seat (42) wherein a concave is inside and a movable piece(43) is at the bottom of the fitting seat (42). Join the outer frame (10) and the back-supporting-unit connected piece (111) via the movable piece (43) to enable the movable piece (43) move back and forth pivotally with the back-supporting-unit connected piece (111), and the back-supporting-unit connected piece (111) can be moved back and forth pivotally with the movable piece (43). As shown in FIGS. 12 and 13, when the movable piece (43) moves to A (44), the inner side of the concave in the fitting seat (42) leans against the vertical unit (12) of the outer frame (10) to be in an upright position; when the movable piece (43) moves to B (45), only one end of the inner side of the concave in the fitting seat (42) touches the vertical unit (12) of the outer frame (10) to be in a slantwise position.

Figure 8:
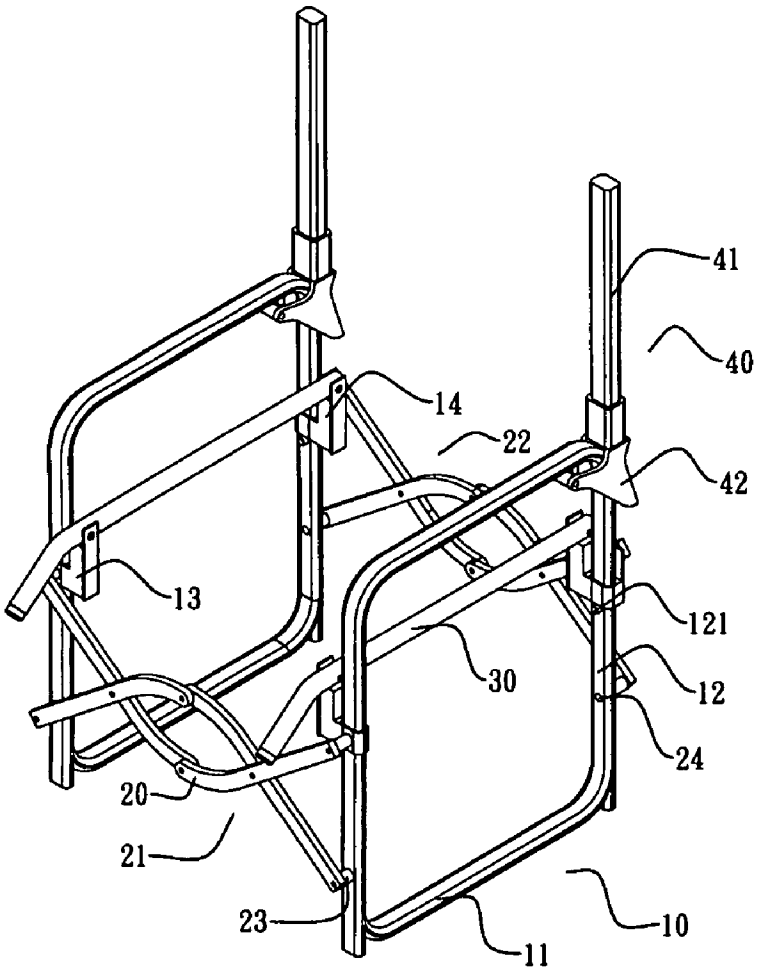
FIG. 8 is a perspective view of the director's chair in unfolding position of the preferred embodiment according to the present invention.
Figure 11:
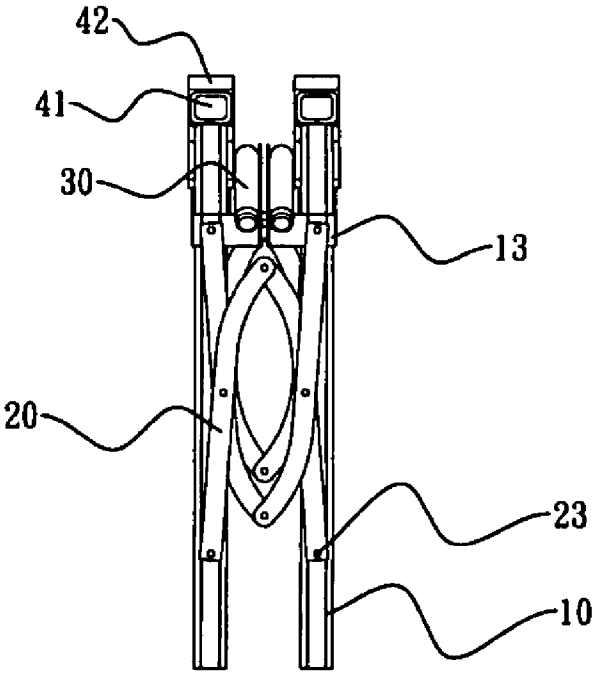
FIG. 11 is a front view of the director's chair in folding position of the preferred embodiment according to the present invention.
Figure 10:
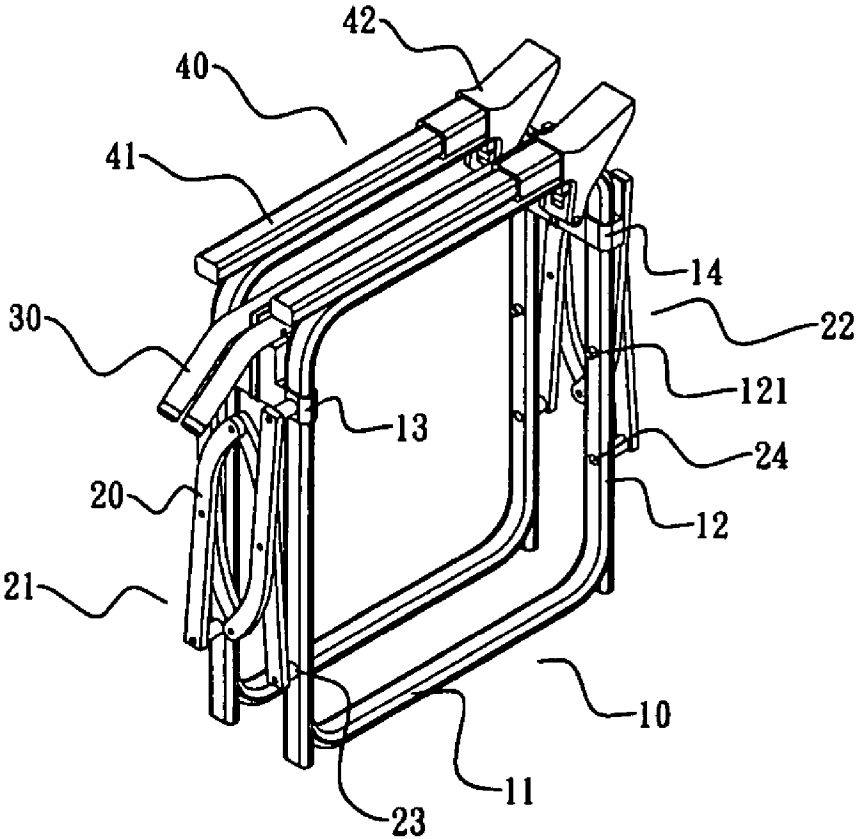
FIG. 10 is a perspective view of the director's chair in folding position of the preferred embodiment according to the present invention.
Figure 15:
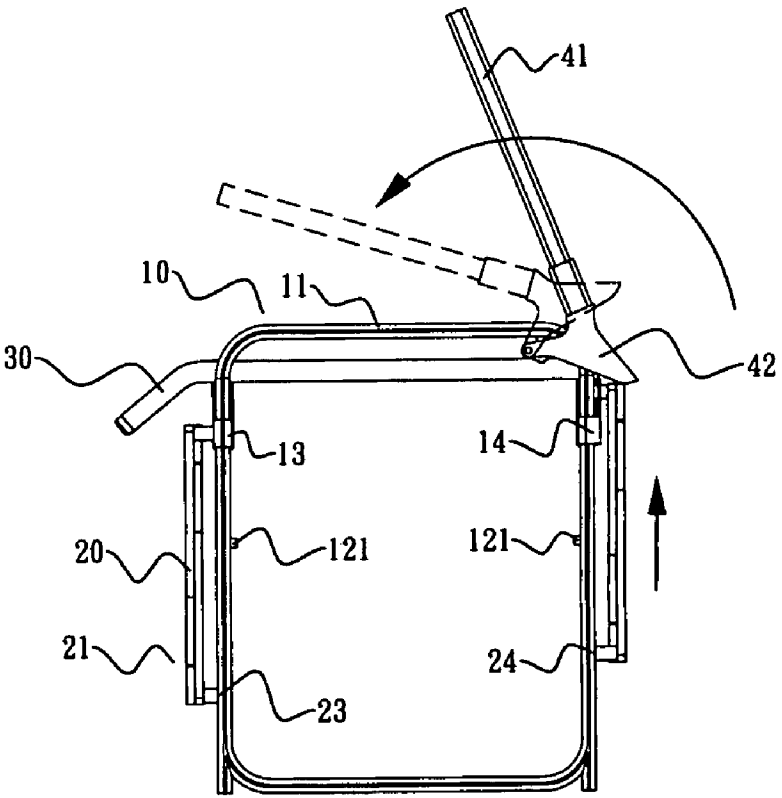
FIG. 15 is a schematic drawing illustrating the folding position of the back supporting unit according to the present invention.
Figure 14:
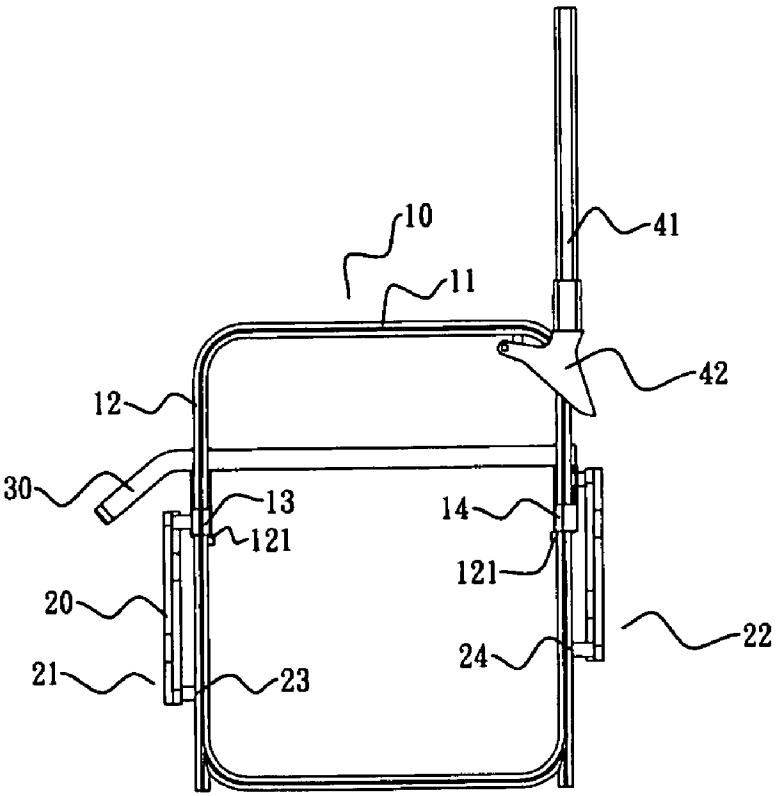
FIG. 14 is a side view of the director's chair in folding position of the preferred embodiment according to the present invention.
Figure 17:
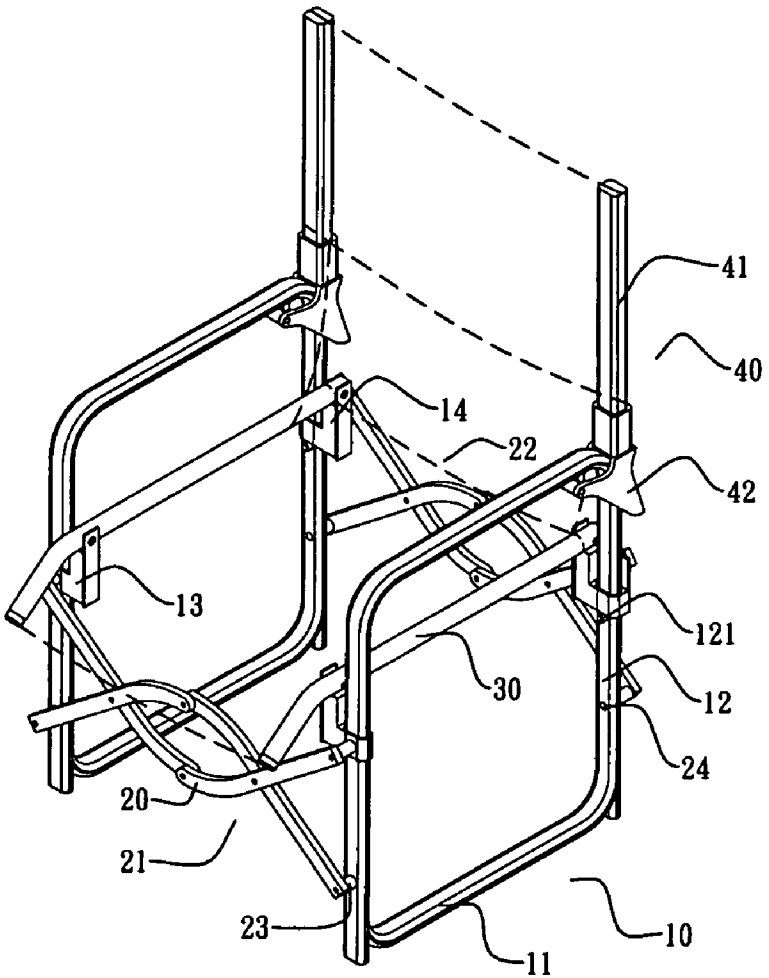
FIG. 17 is a perspective view of the director's chair matching with a seat cover in extension position of the preferred embodiment according to the present invention.
Figure 16:
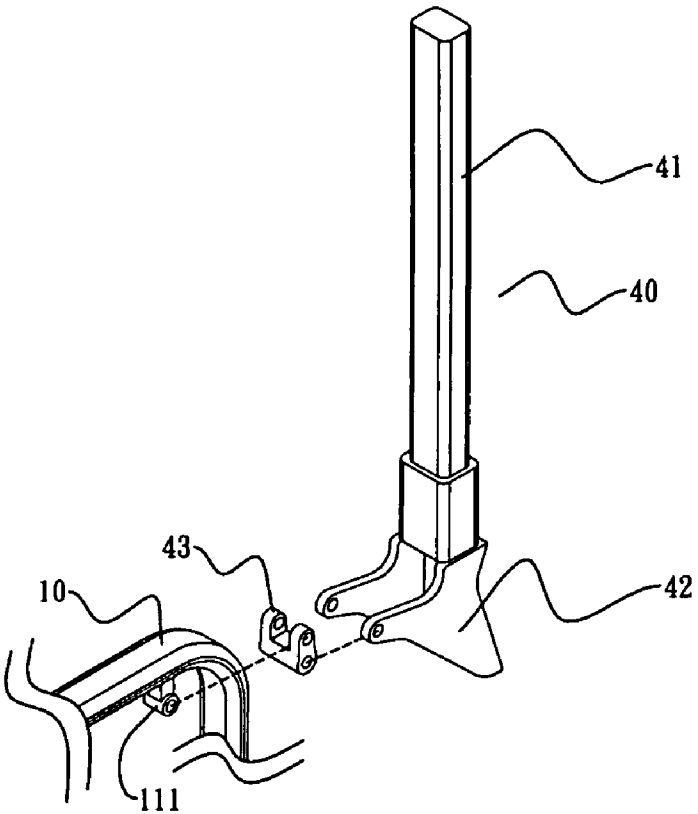
FIG. 16 is a schematic drawing illustrating the composition of the back supporting unit, fitting seat and the movable piece according to the present invention.

As shown in FIG. 8, when the whole structure is in an unfolding position, sliding piece 1 (13) and sliding piece 2 (14) are stopped by the stoppers (121) to hold the structure and to prevent the structure over unfolded. As shown in FIG. 15, when the whole structure is in a folding position, the two outer frames (10) moving inward to drag sliding piece 1 (13) and sliding piece 2 (14) to slide upward along the vertical unit (12) with the connecting units (20). During the upward process, sliding piece 2 (14) touches the fitting seat (42) of the back supporting unit (40) and keeps elevated to enable the back supporting unit (40) collapse down and fold the whole structure.

Figure 18:
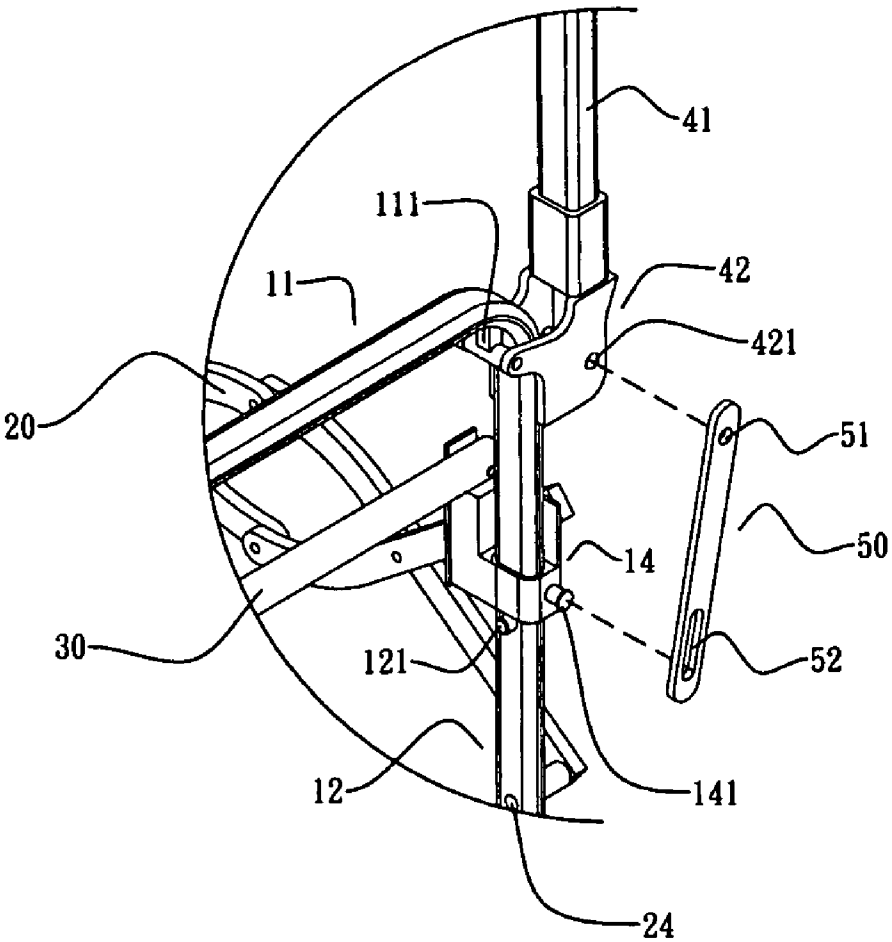
FIG. 18 is a schematic drawing of the better example illustrating the linking member according to the present invention.
Figure 20:
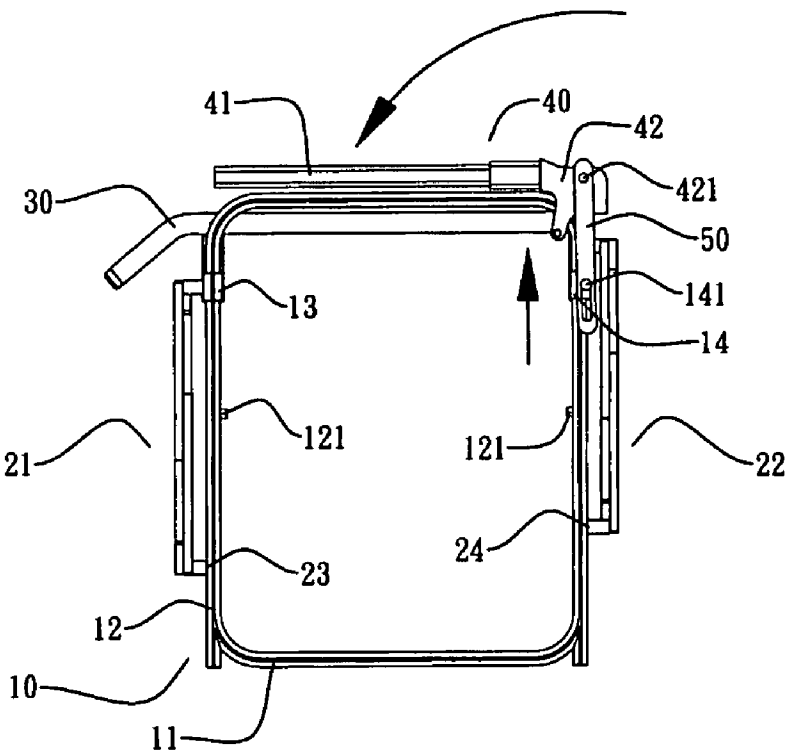
FIG. 20 is a schematic drawing illustrating the folding position of the better example according to the present invention.
Figure 19:
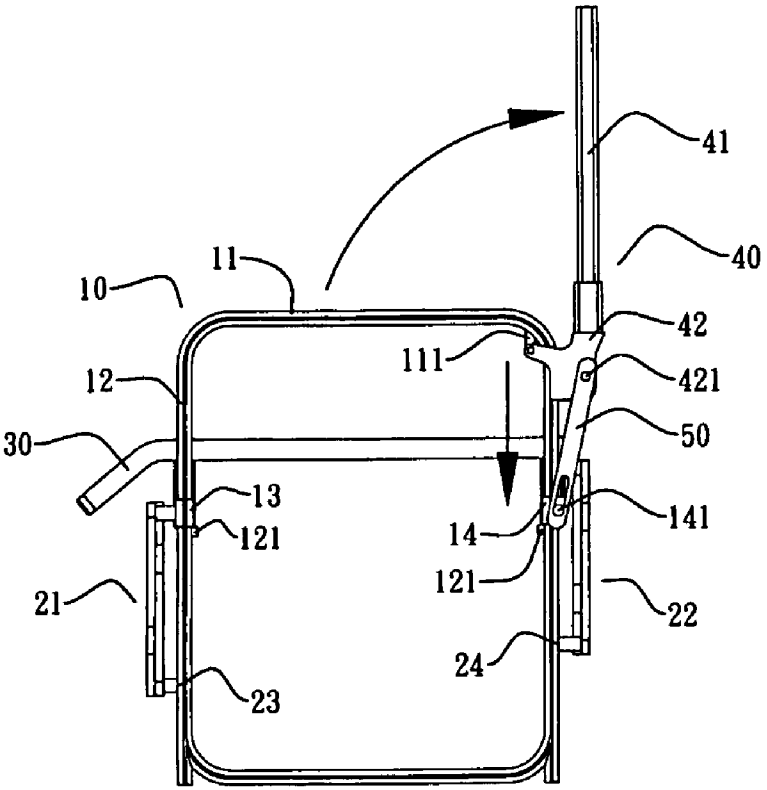
FIG. 19 is a schematic drawing illustrating the unfolding position of the better example according to the present invention.

As shown in FIGS. 18 through 20, this is the better example for the preset invention, set the fitting seat (42) on the back-supporting-unit connected piece (111) without the movable piece (43). A linking member (50) and a protruding piece (141) on sliding piece 2 (14) are provided; a fitting hole (421) is provided on the fitting seat (42) of the back supporting unit (40); a linking hole (51) and a linking cavity (52) is on the linking member (50). The linking hole (51) on the linking member (50) connects with the fitting hole (421), and the protruding piece (141) wedges in the linking cavity (52). When the whole structure is in a folding position, the connecting units (20) drag the sliding piece 2 (14) to move upward, and after the protruding piece (141) wedges in the linking cavity (52) on the linking member (50), the linking member (50) moves upward and the fitting seat (42) which connecting with the linking member (50) through the linking hole (51) is also dragged to move forward to enable the back supporting unit (40) collapse down to fold the whole structure. When the whole structure is in an unfolding position, the sliding piece 2 (14) moves downward to drag the linking member (50) down, this enables the back supporting unit (40) move backward to the upright position and thus unfold the whole structure.

I claim

1. A director's chair comprising:

outer frames, connecting units, seat supporting units and back supporting units;

said outer frame in square shape comprises with a pair of horizontal units and a pair of vertical units;

a back-supporting-unit connected piece setting under said horizontal unit at the corner;

a stopper setting inside of each front and rear vertical unit which is respectively capped with sliding piece 1 and sliding piece 2 sliding up and down along said vertical unit;

connecting units which are pivotally crisscrossed with each other to form a U shaped and an up-side-down U shaped connecting structure;

the front protruding end of said seat supporting unit is curved, the front end near the protruding part is joined to said sliding piece 1, and the rear end of said seat supporting unit is joined to said sliding piece 2;

said back supporting unit comprises a supporting unit and a fitting seat wherein a concave is inside and a movable piece is at the bottom of said fitting seat, to join said outer frame and said back-supporting-unit connected piece via said movable piece.

2. A director's chair as recited in claim 1, wherein said sliding piece 1 and said sliding piece 2 can be slide up and down along said vertical unit.

3. A director's chair as recited in claim 1, wherein connecting structure 1 is located in front of the whole structure wherein two ends of the U shape are joined to said sliding piece 1 on each vertical unit;

two ends of the up-side-down U shape are fixed to retaining spot 1 on each vertical unit;

connecting structure 2 is located on the backside of the whole structure wherein two ends of the U shape are joined to said sliding piece 2 on each vertical unit;

two ends of the up-side-down U shape are fixed to retaining spot 2 on each vertical unit;

said sliding pieces are located above said retaining spots.

4. A director's chair as recited in claim 3, wherein said retaining spots 2 are higher than said retaining spots 1, therefore, said connecting structure 2 is located higher than said connecting structure 1.

5. A director's chair as recited in claim 1, wherein said fitting seat on said back-supporting-unit connected piece can be set without said movable piece;

a protruding piece on said sliding piece 2 is provided;

a fitting hole is provided on said fitting seat of said back supporting unit, and then connect sliding piece 2 and said fitting seat via a linking member;

a linking hole and a linking cavity is on said linking member;

said linking hole on said linking member connects with said fitting hole on said fitting seat, and said protruding piece on said sliding piece 2 wedges in said linking cavity, to set said linking member outside of said sliding piece 2 and said fitting seat.

* * * * *